US005810090A

United States Patent [19]

Sundholm

[11] Patent Number: 5,810,090

[45] Date of Patent: Sep. 22, 1998

[54] METHOD FOR FIRE FIGHTING

[76] Inventor: Göran Sundholm, Ilmari Kiannon kuja 3, FIN-04310 Tuusula, Finland

[21] Appl. No.: 569,490

[22] Filed: Dec. 8, 1995

Related U.S. Application Data

[63] Continuation-in-part of Ser. No. 946,301, Nov. 2, 1992.

[30] Foreign Application Priority Data

| | | | |
|---|---|---|---|
| Jun. 19, 1991 | [FI] | Finland | 913018 |
| May 5, 1992 | [FI] | Finland | 922020 |
| May 22, 1992 | [FI] | Finland | 922355 |
| Jun. 18, 1992 | [WO] | WIPO | PCT/FI92/00193 |

[51] Int. Cl.[6] ..... A62C 2/00

[52] U.S. Cl. ..... 164/46; 169/9; 169/62; 169/43; 169/44

[58] Field of Search ..... 169/46, 9, 62, 169/43, 44

[56] References Cited

U.S. PATENT DOCUMENTS

| | | | |
|---|---|---|---|
| 3,590,924 | 7/1971 | Emmons | 169/43 |
| 3,592,270 | 7/1971 | Livingston | 169/16 |
| 5,161,621 | 11/1992 | Sholmo | 169/43 |

FOREIGN PATENT DOCUMENTS

| | | | |
|---|---|---|---|
| 971365 | 11/1982 | U.S.S.R. | 169/62 |
| 1674865 | 9/1991 | U.S.S.R. | 169/9 |

*Primary Examiner*—Gary C. Hoge
*Attorney, Agent, or Firm*—Ladas & Parry

[57] ABSTRACT

The object of the invention is to provide a new method for extinguishing fires. The method is advantageously used for fighting fires in engine rooms and similar spaces. According to the method, the fire is extinguished or at least suppressed by means of concentrated fog sprays with strong penetrating power, by utilizing high operating pressure, which is gradually decreased for the provision of spread fog-like liquid spraying providing for effective heat absorption and control of fire. The extinguishing liquid is preferably delivered to spray heads (43, 44, 45) by using hydraulic accumulators (41, 41*a*).

10 Claims, 7 Drawing Sheets

METHOD FOR FIRE FIGHTING

This is a continuation-in-part of application 07/946,301 filed Nov. 2, 1992 which is internation application PCT/FI92/00193 filed Jun. 18, 1992, now U.S. Pat. No. 5,713,417 granted Feb. 3, 1998.

BACKGROUND OF THE INVENTION

The present invention relates to a method for fire fighting. The method can advantageously be used for fighting hazardous liquid fires which e.g. may occure in engine rooms of ships and the like.

In spite of big amounts of water, prior art methods and sprinkler installations have proved to be ineffective for extinguishing liquid fires.

Prior art methods using foam-extinguisher installations have also proved to be ineffective, because the foam cannot suppress the fire sufficiently due to insufficient cooling effect and because it is destroyed by high temperature and flue gases generated by the fire.

The object of the present invention is to provide a new method for extinguishing liquid fires in engine rooms of ships and the like. The method is carried out by using a novel type of sprinklers capable of producing concentrated fog sprays at high operating pressure. Such a sprinkler is described e.g. in U.S. patent appln. 07/946,300.

SUMMARY OF THE INVENTION

The present invention provides a method for fire fighting, especially in engine rooms and similar spaces, comprising the steps of

- delivering extinguishing liquid using pressure charged energy
- spraying extinguishing liquid in the form of concentrated fog sprays with strong penetrating power via spray heads and using a high operating pressure in order to at least suppress a fire broken out, whereafter
- a spread fog-like liquid spraying is sprayed via said spray heads using an operating pressure that is lower than said high operating pressure in order to effect effective heat absorption and control of fire. The high operating pressure is preferably 100 to 300 bar.

The fog sprays, i.e. mist sprays, with strong penetration power possess a high momentum enabling the sprays to penetrate a fire. This is very important in order to suppress the fire. The medium droplet size of the concentrated penetrating liquid fog sprays shall be below 500 microns in order that the present method shall work efficiently.

The word "mist" is nowadays used for the word "fog" employed in the present appliation, c.f. "US NFPA 750 Draft Standard IMO Guidelines for Fire Protection".

By means of fire fighting equipment, which are described e.g. in the Finnish Patent Applications 911028, 912434, 913059, 914704, 914823 and 915078 all in the name of G6ran Sundholm, and U.S. patent applns 07/946,301 (corresponding to FI 911028), 07/946,300 (corresponding to FI 912434, 913059, 914704 and 915078) and 08/175,392 (corresponding to FI 914823) and which can operate at a high pressure and with small amounts of water and thereby cause an effective fog-like spraying of extinguishing liquid, it is possible to extinguish a fire in an engine room of a ship, for instance, using only a small amount of water, e.g. a fire of IO MW in a small engine room needs 10 liters water to be extinguished in 3 seconds.

Such a small amount of water is, however, not capable of cooling down hot surfaces heated by the fire sufficiently, so risk for reignition can remain.

The need of high pressure water is great during a short time of e.g. 10 seconds. Electric driven pump would lead to a disproportionate size of electric power requirement.

According to a preferred embodiment of the invention, pressure charged energy is utilized in the form of pressure bottles or cylinders, so-called hydraulic accumulators, in which nitrogen or air is suitably used as propellant gas. The gas is compressed to maximum operating pressure, and therewith, energy is accumulated. The charging pressure is preferably about 140 to 280 bar.

After the fire has been either extinguished or at least suppressed by means of concentrated fog sprays capable of penetrating the hot plume of flue gases, a need of cooling in general arises in the first place. The concentrated fog sprays imply in this connection a certain waste of the restricted amounts of water available. A more evenly spread fog-like liquid spraying results in an improved capability of absorbing heat. The flow resistance, e.g. k factor, of the individual nozzles of the spray heads can preferably be adjusted in such a way that spread fog formation occurs when the pressure of the accumulators has fallen during discharge, whereby the initial counterpressure of the accumulators can be about 70 bar. The spread fog formation is also gentle to possible electric installations.

The fire fighting installation carrying out the present method comprises typically several hydraulic accumulators which preferably may be discharged in cycles so that the above function of the spray heads can be repeated. Between the discharges the accumulators can preferably be recharged. During the recharge or before the concentrated fog sprays, liquid with a low pressure of 5 to 10 or 25 bar can be sprayed through the spray heads for cooling the spray heads and their feed lines. If only the necessity to prevent reignition exists, the recharge of the accumulators can be interrupted at a pressure of e.g. about 110 bar, after which they are permitted to be emptied for spread fog formation. In combination with liquid spraying, also spraying of water additives can be applied for the prevention of reignition. This is preferably done under low pressure, since at high pressure normally additives reduce the penetration of the droplets.

BRIEF DESCRIPTION OF THE DRAWINGS

In the following, the invention will be described more accurately with reference to exemplifying embodiments shown in the enclosed drawing.

DETAILED DESCRIPTION OF THE PREFERRED EMBODIMENT

Figure 1:
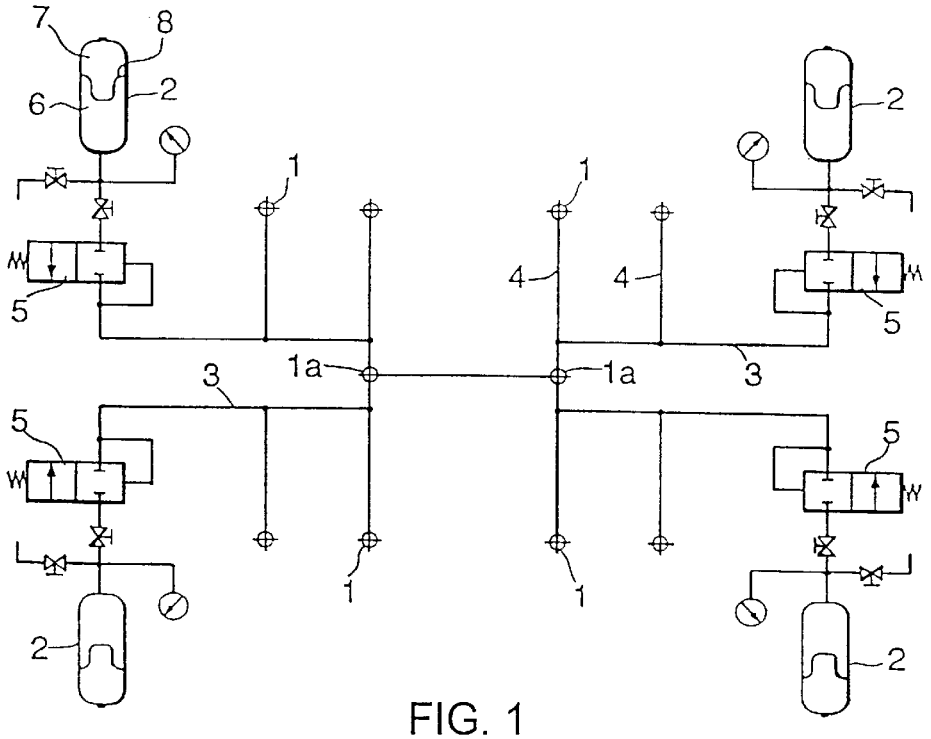
FIG. 1 shows an installation for carrying out the present invention and which is suitable for fire fighting in relatively small spaces in the first place.

In FIG. 1, the reference numerals 1 and 1*a* indicate individual spray heads, of which the spray heads 1 can be located in ship cabins, while the spray heads la can be situated in a cabin corridor. The spray heads 1 are preferably of the type described e.g. in the previous mentioned Finnish Patent Applications 911028, 912434, 913059, 914704, 914823 and 915078 in the name of G6ran Sundholm and U.S. patent applns 07/946,301, 07/946,300 and 08/175,392 in the name of Göran Sundholm.

High pressure hydraulic accumulators, the number of which is four and which are connected in parallel, are indicated by 2, lines extending from the accumulators by 3 and branchings of these to the spray heads by 4. The lines 3 and 4 are preferably flexible fireproof hoses.

At the outlet of each accumulator 2 is preferably positioned a valve 5, which is, in rest position and with no spray head activated, arranged to maintain a relatively low pressure of e.g. 10 bar in the lines 3 and 4. If this pressure falls, i.e. some spray head begins to operate, the valve 5 is opened and a high operating or full working pressure of about 100 to 200 or; even 500 bar enters the spray head in question.

The hydraulic accumulators 2 can comprise a liquid space 6 and a gas space 7 separated by a membrane 8. If the volume of the accumulator is 20:1, the initial pressure is 45 bar and the charging pressure about 200 bar, the accumulator is capable of delivering a liquid flow of about 14 1 in about 1,3 minutes.

Instead of a gas space and membrane, the accumulators can also utilize as driving power a mixture of water and nitrogen or they can be of the piston type, possibly provided with a drive spring.

Figure 2:
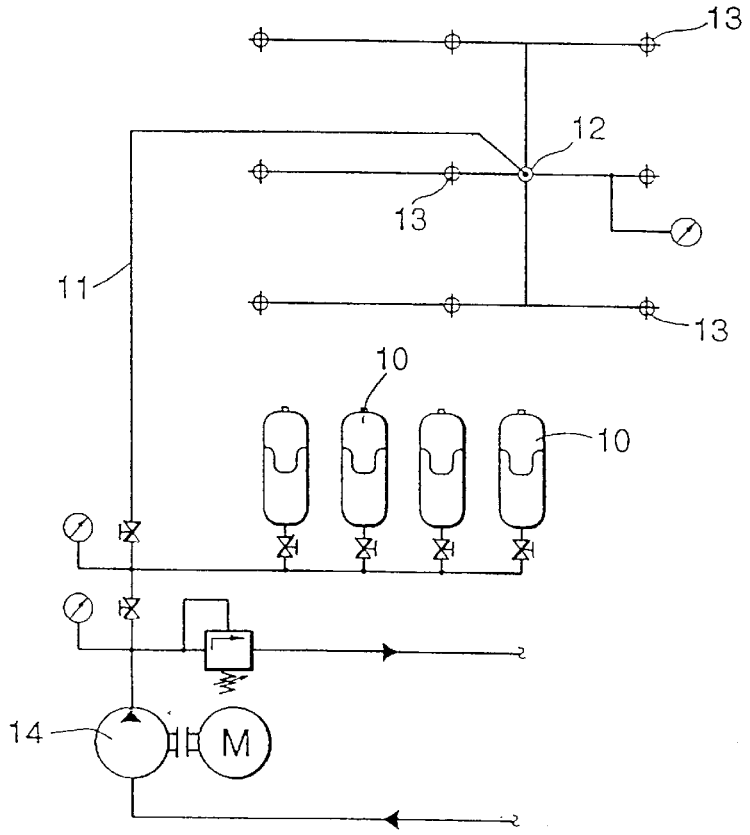
FIG. 2 shows an alternative to the installation of FIG. 1.

In FIG. 2, the reference numeral 10 indicates four hydraulic accumulators connected in parallel, a common outlet line 11 of which leads to an automatic release valve 12, from which extend branchings to a number of spray heads 13. A motor-driven pump 14 is utilized for charging the hydraulic accumulators 10. The sprayheads 13 are preferably of the type described e.g. in the previous mentioned Finnish Patent Applications 911028, 912434, 913059, 914704, 914823 and 915078 in the name of Göran Sundholm and U.S. patent applns 07/946,301, 07/946,300 and 08/175,392 in the name of Göran Sundholm.

Figure 3:
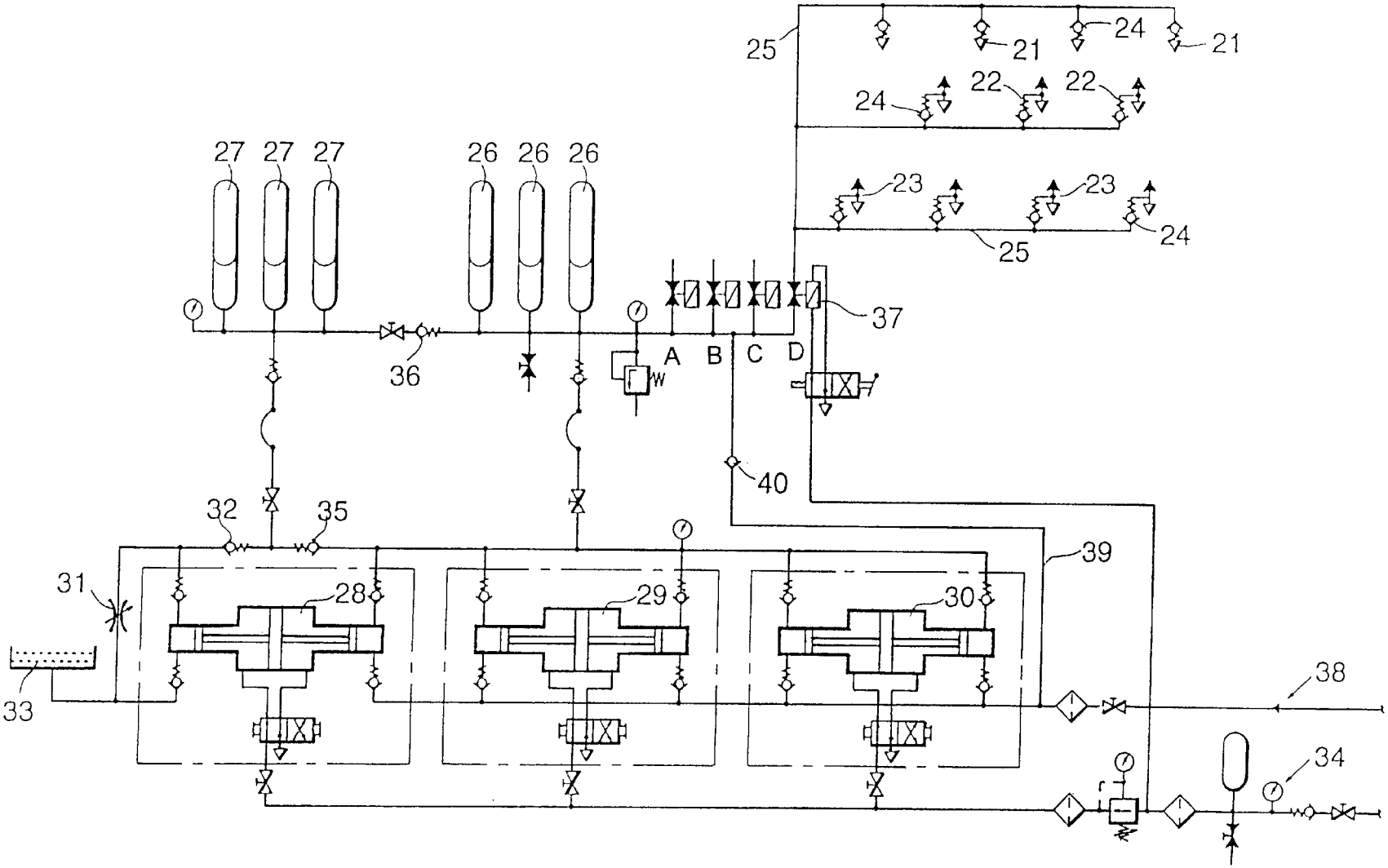
FIG. 3 shows a installation especially intended to be used for fire fighting in engine rooms of ships or similar spaces.

In FIG. 3, the reference numeral 21 indicates a number of spray heads e.g. above a Diesel engine in an engine room, 22 indicates spray heads positioned by the engine, e.g. in the grates of floor, and 23 indicates spray heads in a floor plate above the bilge. The spray heads 21, 22 and 23 are preferably of the type described e.g. in the previous mentioned Finnish Patent Applications 911028, 912434, 913059, 914704, 914823 and 915078 in the name of Göran Sundholm and U.S. patent applns 07/946,301, 07/946,300 and 08/175,392 in the name of Göran Sundholm and capable of producing a water fog under a high working pressure. The spray heads 21 above the motor, which does not appear from the drawing, are directed downwards, while the spray heads 22 and 23 by the motor and in the floor plate, respectively, are preferably provided both with nozzles directed upwards and with nozzles directed downwards.

In front of the spray heads 21, 22 and 23 are positioned nonreturn valves 24 to maintain the pipe system 25 filled with water before starting extinguishing by means of the installation.

Three first hydraulic accumulators for water are indicated by 26 and three second hydraulic accumulators for film forming foam with a foam content of e.g. 3 to 12% are indicated by 27. The charging pressure of the accumulators 26 is e.g. 250 to 300 bar, and when the operating or working pressure of the fire fighting equipment is supposed to be about 100 bar, the water accumulators 26 can have an effective working overpressure of about 140 bar and the foam accumulators 27 an effective working overpressure of about 70 bar, correspondingly.

Compressed-air driven liquid pumps indicated by 28, 29 and 30 are preferably used for charging the accumulators 26 and 27. These pumps are arranged to stop automatically when a set pressure has been achieved. To portion out foam concentrate in the right proportion, the pump 28 is provided with a by-pass flow valve 31 as well as with a nonreturn valve 32 for portioning out a desired percentage of foam concentrate from a tank 33.

The system is charged as follows.

The pneumatic operating system, generally indicated by 34, of the pumps 28, 29 and 30 is switched on, due to which the pumps 28, 29 and 30 start pumping. The left end of the pump 28 in the drawing pumps foam concentrate, the right end of the pump 28 in the drawing and the pumps 29 and 30 pump water. Because the pressure is lower in the accumulators 27 than in the accumulators 26, all pumps pump at first to the accumulators 27. The valve can e.g. be adjusted in such a way that as long as the pressure is lower than 140 bar (overpressure), the foam concentrate from the tank 33 is about 6% of the pump combination.

When the pressure exceeds 140 bar, the water pumps 28, 29 and 30 charge all accumulators, but with still increasing pressure, a bigger and bigger part of the foam concentrate flows via the valve 31, through which the portioning out percentage is kept relatively constant. Valves 35 and 36 prevent the foam from going to the water accumulators 26. After the pressure has risen to a predetermined value, the pumps stop automatically.

The fire fighting method is described as follows referring to FIG. 3.

When a fire breaks out within the sphere of influence of the spray heads 21, 22 and 23, a connecting valve 37 of the pipe system 25 is activated to the accumulator circuit and opens the connection to the pipe system 25. To prevent the charged energy from being wasted for filling the pipe system 25, the spray heads 21, 22 and 23 are provided with the nonreturn valve 24 preventing the pipe system 25 from being emptied.

During the first extinguishing stage, the water accumulators 26 dominate and the spray heads 21–23 spray extinguishing liquid in the form of concentrated fog sprays with strong penetrating power; the addition of foam is very little. After the pressure has fallen to a predetermined value, e.g. 100 bar, a spread fog like spraying is sprayed through the nozzles preferably at 5 to 25 bar. The part of foam increases gradually when the pressure falls in the system, and to this end, the percentage of foam has reached the predetermined value of e.g. about 6%.

The method of extinction according to the invention, as described above, manages with a small amount of foam, or even totally without foam, which as such saves costs and is moreover environment friendly. As an example can be mentioned that about 500:1 of foam concentrate are consumed in a corresponding prior art system with low pressure foam spraying, while the system of the invention copes with only 5 to 10:1 foam. After the pressure has fallen enough as a result of the discharge of the accumulators 26 and 27, the valve 37 is closed and the pumps 28, 29 and 30 start automatically and begin to recharge the accumulators 26 and 27. At this stage the fire is in most cases extinguished. The equipment can, of course, serve several different Diesel engines, boilers, etc., which is indicated in the drawing by means of three valves on the left side of the valve 37.

To secure an even portioning out of foam concentrate, at least the pump 28 is preferably a twin pump for water and foam concentrate, due to which the pump for portioning stops also when the water pump stops; the pump for portioning out foam would otherwise be going all the time.

The reference numeral 38 indicates a water pipe extending to the pumps 28, 29 and 30.

A by-pass branching 39 provided with a nonreturn valve 40 extends from the pipe 38, which branching can be utilized for delivering liquid for continued cooling.

Figure 4:
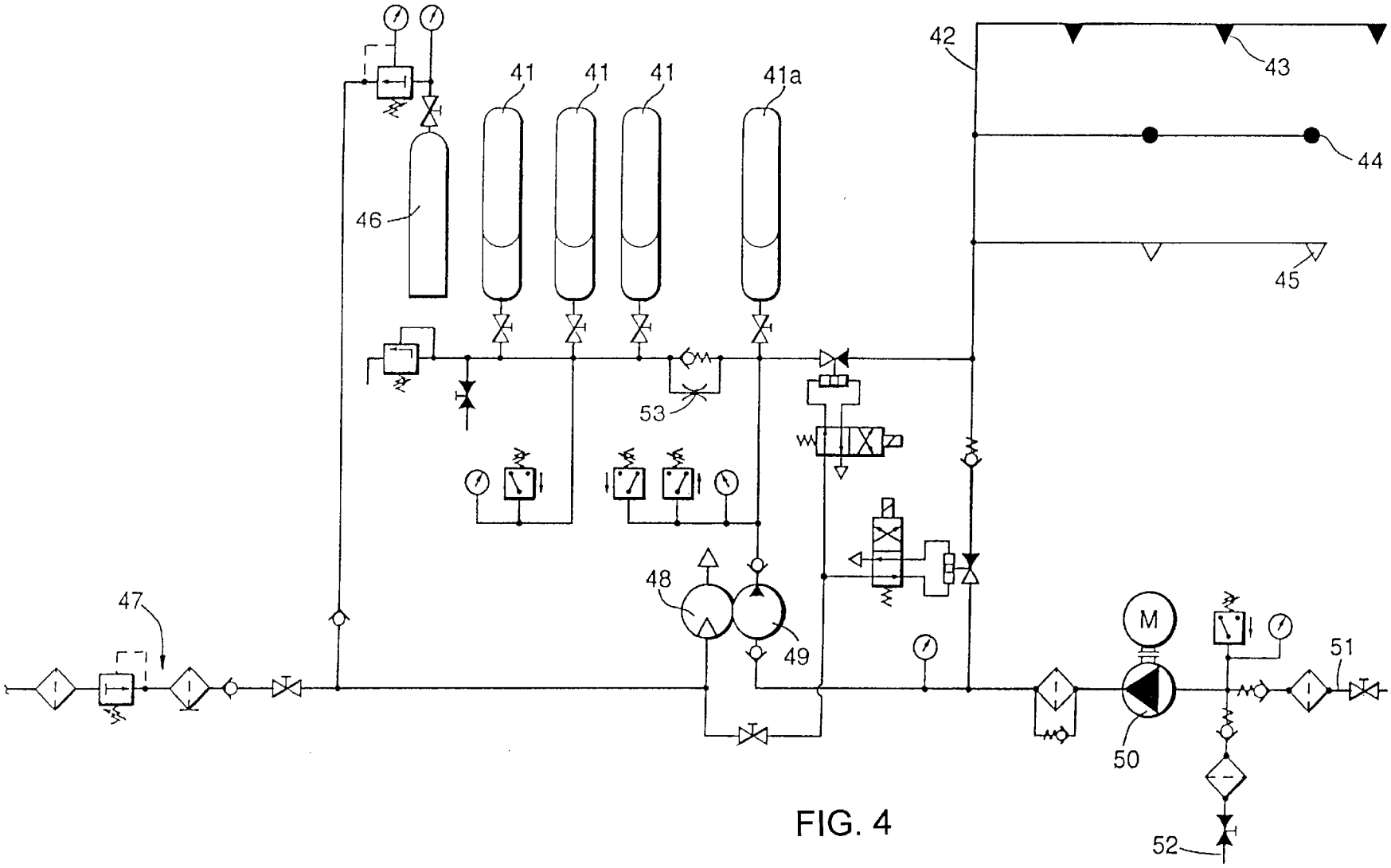
FIG. 4 shows an alternative to the installation of FIG. 3.

In FIG. 4, four hydraulic accumulators connected in parallel are indicated by 41, 41*a*, their common outlet line by 42 and a number of spray heads by 43, 44 and 45, analogously with the spray heads 21, 22 and 23 of FIG. 3. The spray heads 21–23 are preferably of the type described in the previous mentioned Finnish Patent Applications 911028, 912434, 913059, 914704, 914823 and 910578 in the name of Göran Sundholm and U.S. patent applns 07/946,301, 07/946,300 and 08/175,392 in the name of Göran Sundholm. The hydraulic accumulators 41, 41*a* can have an initial pressure of about 70 bar and a volume of about 50 liters each. 46 indicates a pressure bottle, which can have a pressure of 200 bar and a volume of 20 liters and which, in case of disturbance in a compressed-air supply line 47, can be utilized for driving a pneumatic motor 48 driving a pump 49 for charging the accumulators 41, 41*a*.

A motor-driven pump 50 with a working pressure of e.g. 10 to 15 bar can be connected alternatively to a supply line 51 for fresh water, pressure about 5 bar, or to a line 52 for lake- or sea-water, pressure 5 to 10 bar. The pump 50 can be utilized for delivering water to the spray heads 43, 44 and 45, for cooling purposes in the first place, during the time the accumulators 41 are recharged after having been emptied.

At least somewhat before the discharge of the accumulators 41, 41*a*, the pump 50 is preferably arranged to spray low pressure water through the spray heads 43, 44 and 45 to cool these before switching on high operating pressure, through which the spray heads and their nozzles can better resist the mechanical stresses caused by a sudden switching on of fully charged accumulators. The pump 50 can preferably deliver liquid to the spray heads within a larger area immediately after a fire has been detected, until the fire has been located more closely.

A throttling 53 in combination with a nonreturn valve 100 is connected between the hydraulic accumulator 41*a* and the other accumulators 41 in such a manner that the accumulator 41*a* is charged more quickly than the others and can be emptied again, if necessary, after a considerably shorter time than is possible if all accumulators are charged in parallel.

Figure 5:
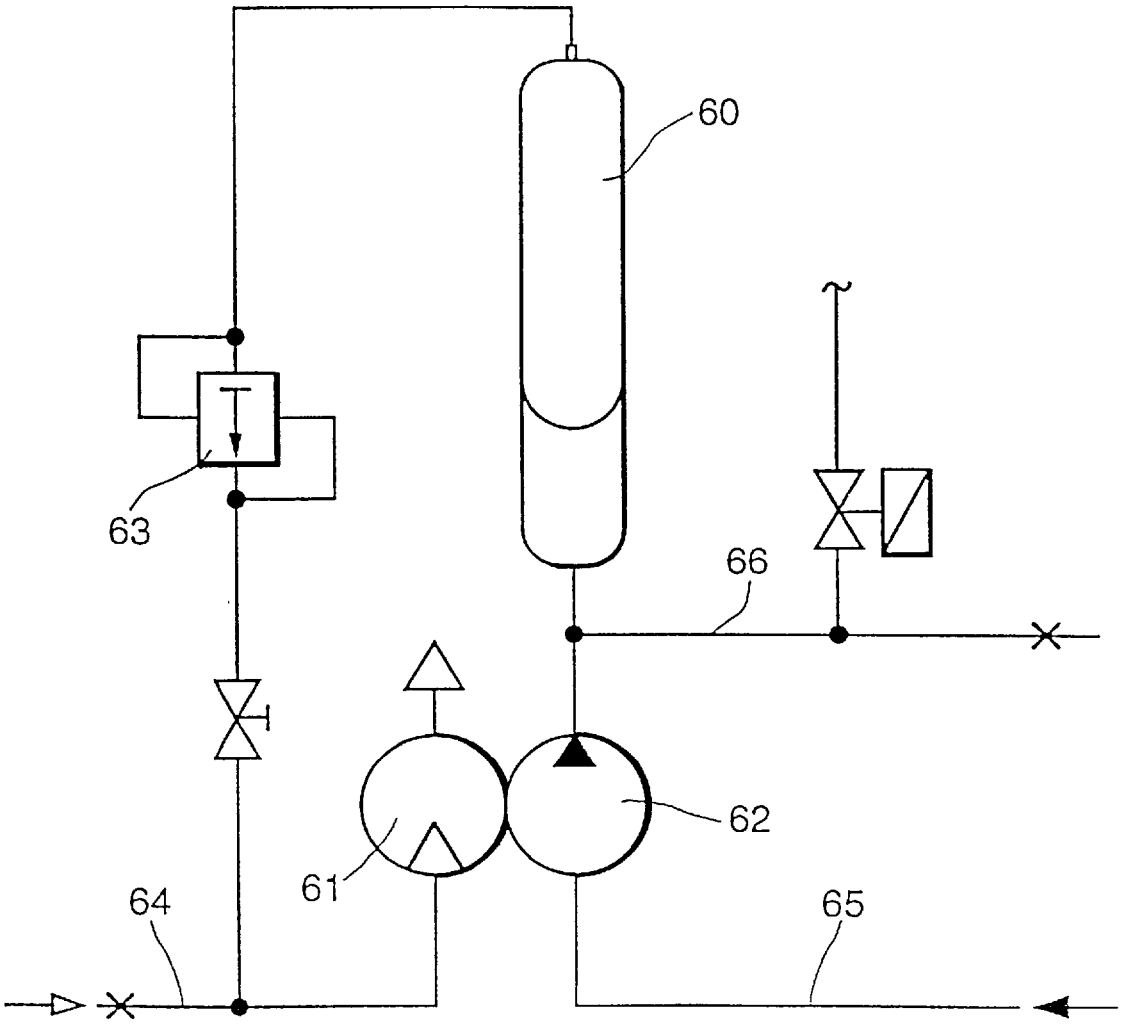
FIG. 5 shows an alternative application of the installation according to FIG. 4.
Figure 6:
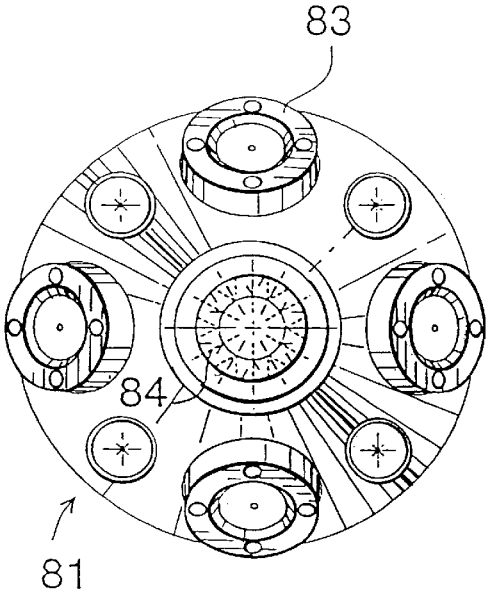
FIG. 6 shows a spray head from the outlet side of the nozzles.

In FIG. 5, the numeral 60 indicates a hydraulic accumulator, 61 indicates a pneumatic motor for driving a pump 62, working pressure e.g. 280 bar, for charging the accumulator 60. The numeral 63 indicates a preferably proportional pressure reducing valve (e.g. 7 bar), which is closed in a normal case, i.e. when the pressure air supply from a line 64 is undisturbed. The liquid supply of the pump 62 is indicated by 65 and the outlet line of the accumulator 60 by 66.

The initial pressure of the accumulator 60 can preferably be relatively high, e.g. about 150 bar. At interruptions in the regular pressure air supply 64, it is therefore possible to utilize the gas existing in the accumulator 60 for recharging the accumulator 60 via the valve 63 after emptying. This possibility of recharging the accumulator 60 is, of course, restricted by the fact that the initial pressure in the accumulator 60 will fall with a decreasing amount of gas, but it shall at least be possible to achieve a degree of charging which enables one repeated discharge or several repeated discharges with spread fog-like liquid spraying.

In FIGS. 6 to 9 is shown a spray head which can be used in the method according to the present invention and the installation need for carrying out the present method. The reference numeral 81 indicates generally a spray head, the body or housing of which is indicated by 82. Four nozzles directed obliquely downwards to the sides are indicated by 83, and a centrally positioned nozzle by 84. The nozzles 83 are intended to work at high pressure of e.g. 100 bar or more to cause a fog-like liquid spraying, preferably in mutual cooperation to form a common directional fog spray with high penetrating power. The construction and mutual arrangement of the nozzles 83 correspond preferably to what has been said in the earlier mentioned Finnish Patent Applications 912434, 913059, 914704 and 915078.

The liquid inlet of the spray head 81 is indicated by 85, from the inlet 85 extends a central channel 86, which leads directly to the central nozzle 84 and from which extend channels 87 to the nozzles 83.

Figure 7:
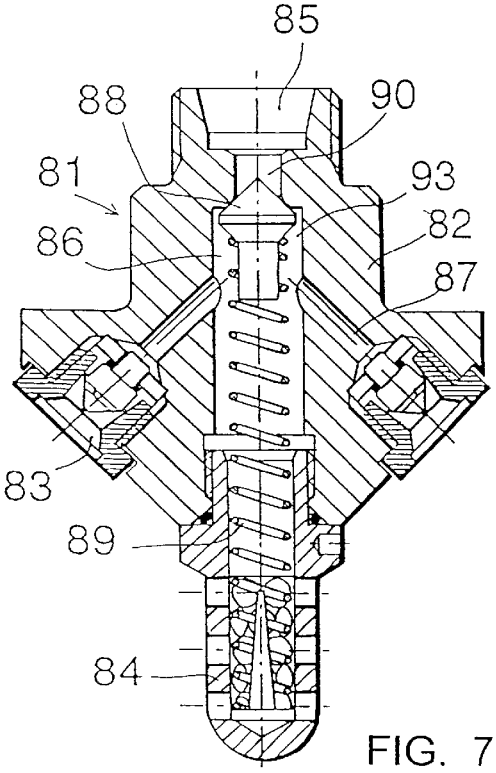
FIG. 7 shows a longitudinal section of a spray head, in an inactive state.

In the channel 86 is positioned a valve body 88, bearing against the inlet end of the channel 86 under the influence of a spring 89 and closing the connection 90 between the liquid inlet 85 and the channel 86, when the spray head is in an inactive state, FIG. 7. For this purpose, the valve body 88 comprises e.g. a cone 61 to bear against a likewise conical sealing surface 92 of the housing 82.

Figure 8:
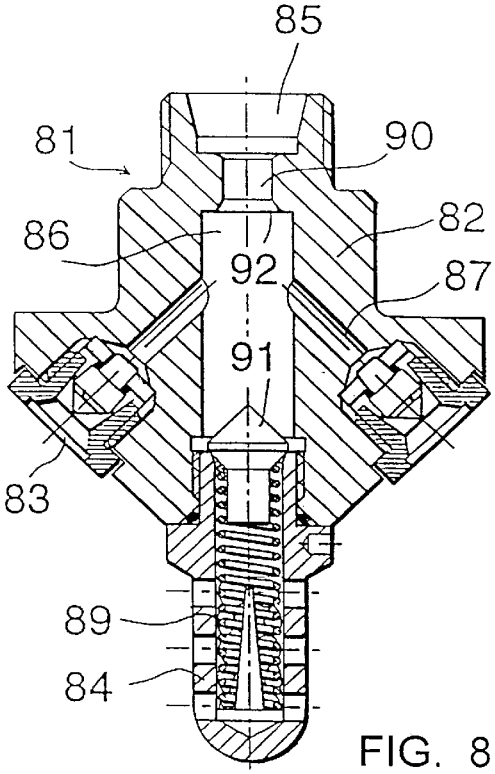
FIG. 8 shows a spray head at a first stage of an activated state similarly to FIG. 7.

After a fire has broken out, the fire fighting equipment is activated and there is a high pressure of e.g. 100 bar at the inlet 85. The high pressure surpasses the spring 89 and presses the valve body 88 apart from the surface 92, while liquid flows past the cone 91 via a split 93 between the base of the cone 91 and the wall of the channel 86. The split 93 is so narrow that the pressure fall in the split becomes great enough to surpass continuously the force of the spring 89, whereby the valve body 88 strikes right down to the bottom of the channel 86 and closes the connection from this to the central nozzle 84, preferably by means of a conical contact sealing like 91, 92; FIG. 8.

Figure 9:
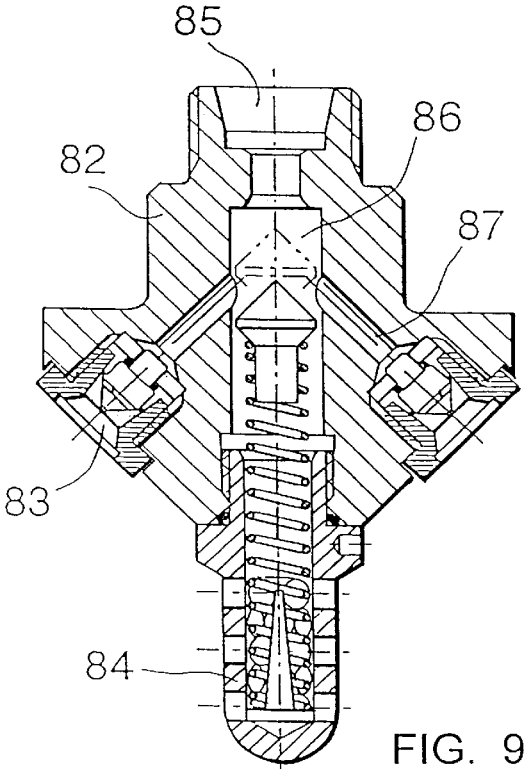
FIG. 9 shows a second stage of the activated state in a corresponding manner.

If the extinguishing liquid is delivered by the hydraulic accumulators, the pressure in these falls gradually until the spring 89 is capable of pressing the valve body 88 apart from the position of FIG. 8 to a position according to FIG. 9, approximately in the middle portion of the channel 86, whereby the liquid flows past the valve body 88 to the central nozzle 84 having a lower flow resistance than the nozzles 83 and spraying a spread fog-like liquid spraying. In the vast majority of cases, the fire is already extinguished at this stage by means of the fog sprays through the nozzles 83 during the first step of extinction, shown in FIG. 7, and the continued liquid spraying through the central nozzle 84 serves in the first place for cooling in order to prevent a reignition. A continued spraying of liquid through the central nozzle 84, in the position of FIG. 9, is possible, if necessary, by utilizing a conventional water pipe with a pressure of about 7 bar, even after the hydraulic accumulators have been emptied entirely and are possibly being recharged.

The nonreturn valves 24 drawn separately in FIG. 3 are included in the spray head in accordance with the FIGS. 6 to 9. The same function can be provided, however, by utilizing the principle shown in the FIGS. 6 to 9 for instance in such a way that a spray head with only a central nozzle and valve body and spring, but without side nozzles 83, is connected to a pipe portion between two so to speak common spray heads without valve body 88 and spring 89. At low or no pressure in the pipe portion, the connection is closed and it is opened when high pressure is switched on.

Before the valve body 88 of the spring 89 has been pressed loose from the position of FIG. 8 to the position of FIG. 9, concentrated fog sprays with strong penetration have at first been sprayed via the nozzles 83, and later, after the operating pressure has fallen, spread fog-like liquid has been sprayed via the nozzles.

Figure 10:
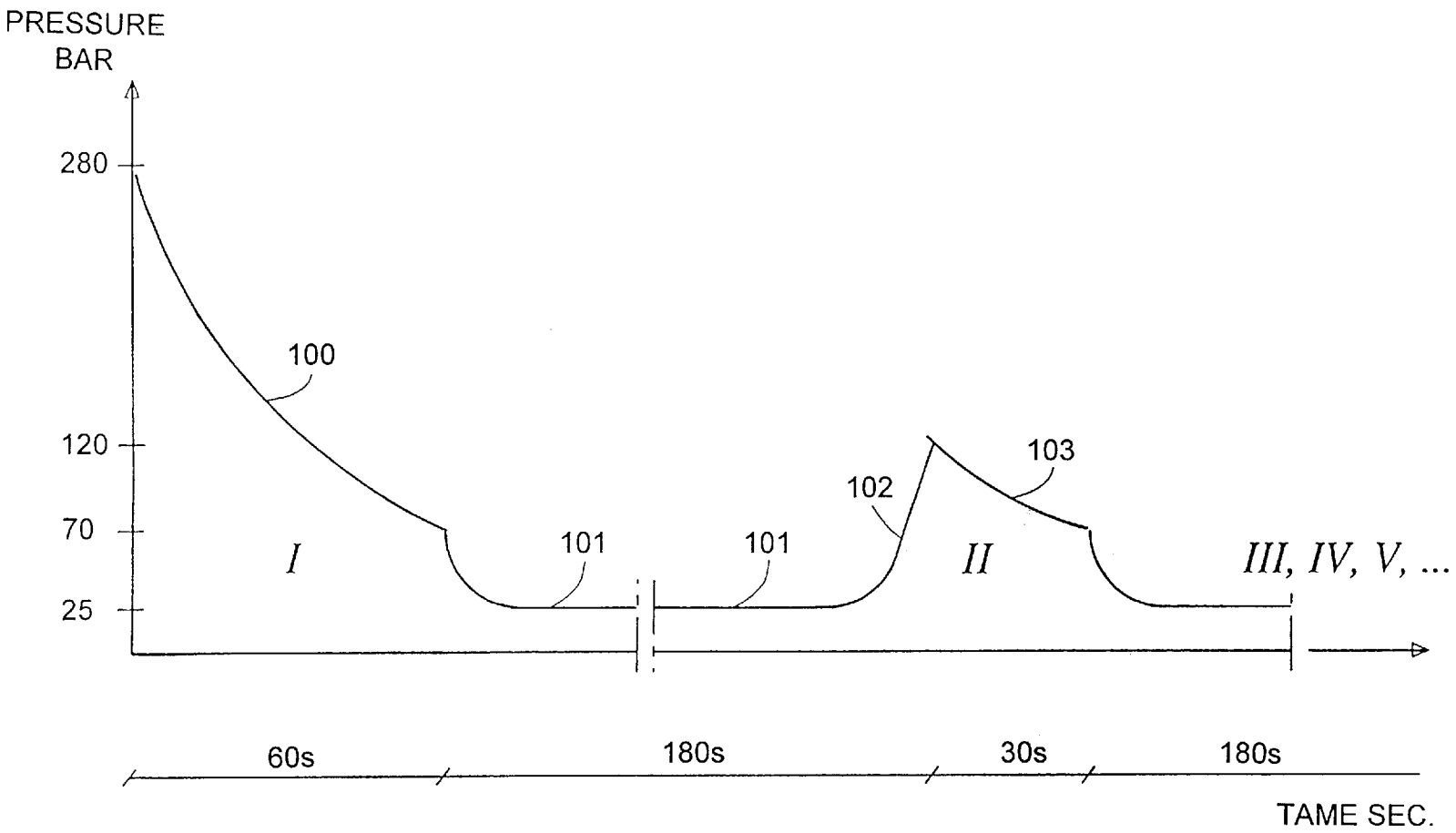
FIGS. 10 and 11 show the extinguishing procedure using the installation of FIG. 4 as a function of time and pressure.
Figure 11:
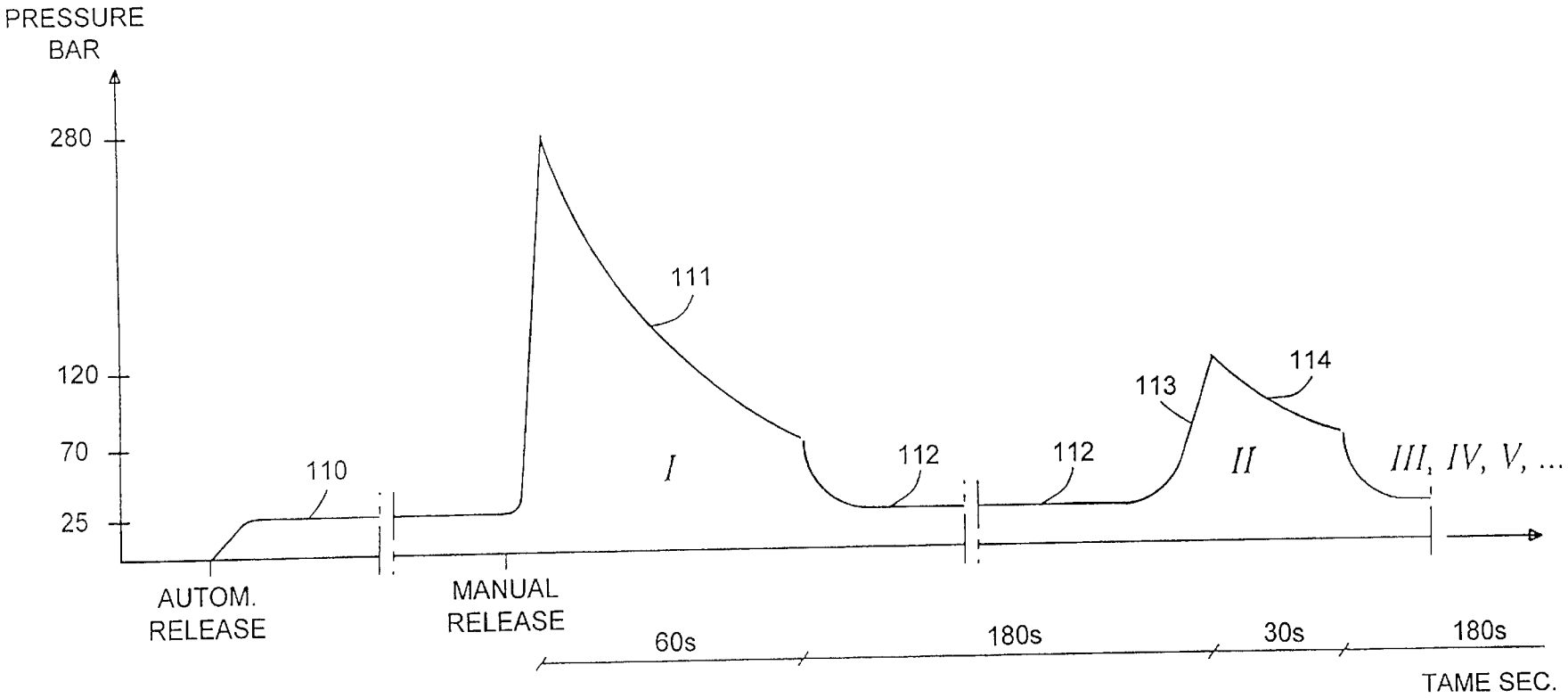

FIGS. 10 and 11 show the extinction procedure of the embodiment according to FIG. 4 as a function of time and pressure. The procedure is similar also in the other embodiments.

In each figure, I, II, III, IV, V, . . . indicate the first, second, third, fourth, fifth . . . discharge of one or several hydraulic accumulator(s) 41, 41*a*.

A curve section 100 of FIG. 10 includes both spraying of concentrated fog sprays and spread fog-like spraying. A curve section 101 refers to spread fog-like spraying with liquid supply directly from the pump 50 with a pressure of about 20 to 25 bar. A curve section 102 refers to a partial charge of at least the hydraulic accumulator 41*a*, a section 103 to repeated spread fog-like spraying, etc.

In FIG. 11, the curve section 110 refers to general spread fog-like spraying by means of the pump 50 until the fire seat has been located more closely, a section 111 corresponds to the section 100 in FIG. 10, a section 112 corresponds to the section 101, a section 113 corresponds to the section 102 and a section 114 corresponds to the section 103 of FIG. 10. The recharging sections 102 and 113 can naturally be varied according to need.

I claim:

1. A method for fire fighting, comprising the steps of:

delivering extinguishing liquid using pressure charged energy;

spraying said extinguishing liquid in the form of concentrated fog sprays with strong penetrating power from spray heads and a high operating pressure of about 100–300 bar in order to at least suppress a fire; and thereafter spraying said extinguishing liquid in the form of spread fog-like sprays from said spray heads and a lower operating pressure that is lower than said high operating pressure in order to effect effective heat absorption and control of said fire.

2. The method according to claim 1, wherein said delivering uses at least one high pressure hydraulic accumulator for providing said pressure charged energy and operating pressures of said extinguishing liquid that are reduced gradually from said high operating pressure to said lower operating pressure.

3. The method according to claim 2, wherein foam is sprayed after said spraying of said extinguishing liquid at said high operating pressure.

4. The method according to claim 3, wherein the amount of said foam is gradually increased as said operating pressures are gradually reduced.

5. The method according to claim 1, wherein a liquid at a low pressure of 5 to 20 bar is maintained in piping leading up to said spray heads before said high operating pressure of about 100–300 bar of said extinguishing liquid, said delivering being through said piping.

6. The method according to claim 1, wherein, before said spraying of said concentrated fog sprays, liquid is sprayed through said spray heads at least during a short time from another operating pressure that is lower than said high operating pressure to cool said spray heads.

7. The method according to claim 6, wherein said another operating pressure is 5 to 25 bar.

8. The method according to claim 1, wherein said concentrated fog sprays having a medium droplet size below 500 microns.

9. The method according to claim 1, wherein said spray heads are provided with at least two first nozzles with a first orifice size and at least one second nozzle with a second orifice size smaller than said first orifice size for said spraying of said concentrated fog sprays through said at least two first nozzles and said spread fog-like sprays through said at least one second nozzle.

10. A method for fire fighting, comprising the steps of:

delivering extinguishing liquid using pressure charged energy;

spraying said extinguishing liquid in the form of concentrated fog sprays with strong penetrating power from spray heads and a high operating pressure of about 100–300 bar in order to at least suppress a fire; and thereafter spraying said extinguishing liquid in the form of spread fog-like sprays from said spray heads and a lower operating pressure that is lower than said high operating pressure in order to effect effective heat absorption and control of said fire;

wherein said delivering uses a number of hydraulic accumulators connected in parallel and discharged in cycles;

wherein said hydraulic accumulators are charged between said cycles; and wherein said extinguishing liquid is delivered from a pressure of 5 to 10 bar through said spray heads during said charging of said hydraulic accumulators.

* * * * *